United States Patent [19]

Van Herck et al.

[11] Patent Number: 4,651,056

[45] Date of Patent: Mar. 17, 1987

[54] HIGH-PRESSURE DISCHARGE LAMP

[75] Inventors: André J. B. M. Van Herck; Johannes G. W. Etman, both of Eindhoven, Netherlands

[73] Assignee: U.S. Philips Corporation, New York, N.Y.

[21] Appl. No.: 713,524

[22] Filed: Mar. 19, 1985

[30] Foreign Application Priority Data

Mar. 22, 1984 [NL] Netherlands ..... 8400906

[51] Int. Cl.[4] ..... H01J 61/36; H01J 1/18

[52] U.S. Cl. ..... 313/623; 313/290; 313/285

[58] Field of Search ..... 313/623, 624, 625, 244, 313/252, 266, 634, 631, 632, 285, 284, 290

[56] References Cited

U.S. PATENT DOCUMENTS

| | | | |
|---|---|---|---|
| 3,886,392 | 5/1975 | Barakitis et al. | 313/625 |
| 4,019,078 | 4/1977 | Burgess | 313/285 X |
| 4,409,517 | 10/1983 | Van Der Sande et al. | 313/634 X |
| 4,539,511 | 9/1985 | Denbigh et al. | 313/634 X |

*Primary Examiner*—Palmer C. DeMeo
*Assistant Examiner*—Sandra L. O'Shea
*Attorney, Agent, or Firm*—David R. Treacy

[57] ABSTRACT

A cup-shaped lead-through member is sealed in the wall of a ceramic discharge vessel, and has an electrode beam passing through the end wall of the cup-shaped member and sealed thereto. Immediately adjacent the electrode beam, the cup end wall is deformed away from the discharge space and clamps around the electrode beam over a length of at most the diameter of the beam. A mass of sealing material surrounds the beam end and seals it to the lead-through member, the tight fit of the member end wall to the beam preventing flow of sealing material to the interior of the discharge space.

4 Claims, 3 Drawing Figures

HIGH-PRESSURE DISCHARGE LAMP

The invention relates to a high-pressure discharge lamp which comprises a ceramic discharge vessel enclosing a discharge space, containing an ionizable filling and provided with two electrodes, between which a discharge path extends, at least one electrode comprising an electrode beam whose one end passes through the wall of a cup-shaped lead-through member and is connected thereto on the side of the wall of the lead-through member remote from the discharge space in a gas-tight manner.

Lamps of the kind mentioned in the opening paragraph are commonly used nowadays both for public area illumination and for illumination in residences. The filling of the lamps may consist of a combination of one or more metals and one or more rare gases or of a combination of one or more metal halides, mercury and rare gas. The lamps have the advantage of a high luminous flux with comparatively small dimensions and a long life.

A ceramic discharge vessel is to be understood in this description to mean a discharge vessel manufactured from a crystalline oxide, such as, for example, monocrystalline sapphire or polycrystalline densely sintered alumina.

In the known lamps, the electrode beam is passed with a certain amount of clearance through the cup-shaped lead-through member. The gas-tight connection generally consists of a soldering mass which seals entirely the clearance between the electrode beam and the lead-through member.

It has been found that in practice two disadvantages frequently occur with the known lamps. Firstly, it has been found that the provision of a clearance between beam and lead-through member can lead to the electrode beam occupying an oblique position with respect to the discharge vessel, as a result of which the position of the discharge path with respect to the discharge vessel is adversely affected. Moreover, the electrode gap and hence, in the operating condition of the lamp, the voltage between the two electrodes are influenced thereby. A second disadvantage is that, in addition to the soldering mass sealing the space between the electrode beam and the cup-shaped lead-through member, the soldering mass tends also to extend through it a substantial distance into the discharge space. It has been found that this leads to the light and electrical properties of the lamp being influenced detrimentally due to reactions between filling constituents and soldering mass.

The invention has for its object to provide means by which the said disadvantages are substantially avoided. For this purpose, a lamp of the kind mentioned in the opening paragraph is characterized in that the wall of the cup-shaped lead-through member is deformed away from the discharge space around the electrode beam and clampingly engages around the electrode beam over a length along the beam of at most the diameter of the electrode beam. The manner of securing together the beam and the lead-through member in the lamp according to the invention is extremely effective in preventing the soldering mass from extending into the discharge space. Moreover, it has been found that the construction has such strength before soldering that a reproducible positioning of the electrode beam with respect to the lead-through member and the discharge vessel is guaranteed. The invention additionally has the advantage that as compared with the prior art only a negligible quantity of additional material is required.

With respect to the cup-shaped lead-through member, the following remarks can be made. This member, which forms at least in part a boundary of the discharge space, must be resistance for that reason to the filling of the discharge vessel both in the extinguished condition and in the operating condition of the lamp. Moreover, the lead-through member must consist of a material whose expansion coefficient differs only slightly from that of the ceramic discharge vessel into which it is inserted. In practice, the lead-through member may be formed from molybdenum, niobium or alloys of these metals. However, molybdenum and niobium and their alloys are particularly expensive so that it is very advantageous to keep the quantity used per lamp as small as possible.

Means for guaranteeing a correct positioning of the electrode beam with respect to the lead-through member and the discharge vessel are known from British Patent Specification No. 1,290,089. In this known lamp, the lead-through member is mainly constructed as a double-walled cylinder, the inner wall surrounding the electrode beam over a length well beyond the circumference of the discharge space. Although a correct positioning of the electrode beam is thus obtained, due to the double-walled construction of the lead-through member the quantity of material used for this body is very large.

Also in a construction in which the connection between the electrode beam and the lead-through member is arranged well beyond the circumference of the discharge space, as shown in U.S. Pat. No. 4,019,078, the lead-through member requires the use of a considerable quantity of material.

In an embodiment of a lamp according to the invention, the open end of the cup-shaped lead-through member is directed away from the discharge space. This affords the advantage that the wall of the lead-through member, being deformed away by and along the electrode beam, is directed towards the open end of the lead-through member, which—even when this wall is deformed only slightly—leads to a natural clamping of the said deformed away wall against the electrode beam. It should be noted that on account of lamp dimensioning, it is advantageous when the wall is caused to deform away slightly.

The invention can be realized in different ways. According to a reliable and simple manner, the electrode beam is pressed at the base through the wall of the cup-shaped lead-through member. Should the cup-shaped lead-through member have a diameter of more than 400 μm, it may be advantageous to provide beforehand at the base of the cup-shaped lead-through member a hole in its wall having a diameter smaller than the diameter of the electrode beam.

An embodiment of the invention will hereinafter be described more fully with reference to the drawing, in which.

Figure 1:
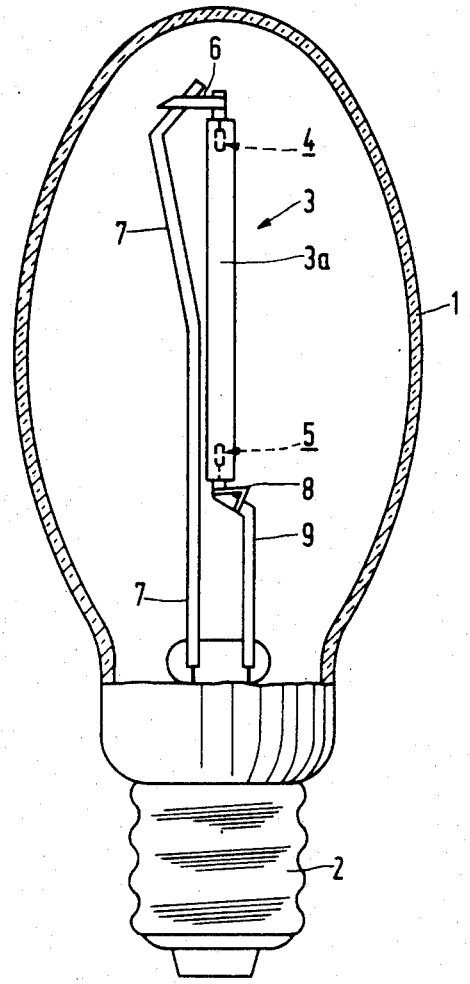
FIG. 1 shows a high-pressure discharge lamp.

In FIG. 1, reference numeral 1 denotes an outer bulb of a high-pressure discharge lamp provided with a lamp cap 2. A ceramic discharge vessel 3 arranged inside the outer bulb encloses a discharge space 3*a* and is provided with two electrodes 4,5, between which a discharge path extends. The discharge vessel contains an ionizable filling, which in the operating condition of the lamp maintains a discharge. The electrode 4 is electrically connected through a conducting strip 6 to a current supply conductor 7, one end of which is connected to a first connection contact of the lamp cap 2. The electrode 5 is electrically connected through a flexible strip 8 to a current-supply conductor 9, which is connected by one end to a second connection contact of the lamp cap 2.

Figure 2:
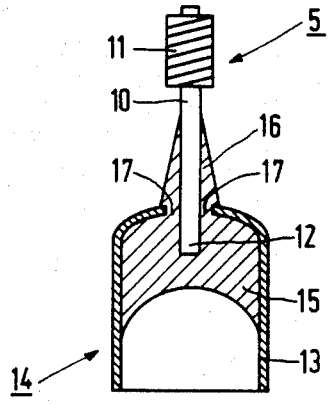
FIG.2 PRIOR ART
FIG. 2 shows in detail in sectional view the connection between the lead-through member and the electrode beam of a known lamp.

In a lamp according to the prior art as shown in FIG. 2, one end 12 of an electrode beam 10 is passed with a certain amount of clearance through the wall 13 at the base of a cup-shaped lead-through member 14. The electrode beam 10 and the lead-through member 14 are connected to each other electrically and in a gas-tight manner by means of a soldering mass 15. The space 17 obtained by clearance between the electrode beam and the lead-through member is then not only sealed, but the soldering mass extends through it for a considerable distance as shown by part 16. The part 16 of the soldering mass can extend over such a distance that it is in direct contact with the turns 11 of the electrode 5.

Figure 3:
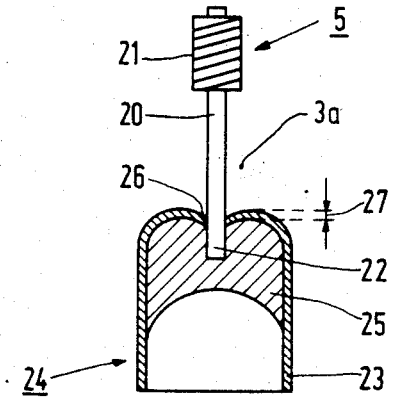
FIG. 3 shows in detail in sectional view the connection between the lead-through member and the electrode beam according to the invention.

In the case of a lamp according to the invention, as shown in FIG. 3, the wall 23 of the cup-shaped lead-through member 24 is deformed away from the discharge space 3*a* around the electrode beam 20. The deformed part 26 of the wall 23 of the lead-through member then laterally clampingly engages around the end 22 of the electrode beam 20, which beam is passed through the wall 23 of the lead-through member 24. The lateral engagement of the part 26 is limited to a length along the beam of at most the diameter of the said beam. The deformed part extends over a length 27 measured in the longitudinal direction of the sleeve-shaped lead-through member.

In a practical lamp having a power rating of 250 W, the ceramic discharge vessel consisted of polycrystalline densely sintered alumina. The filling of the discharge vessel consisted of 25 mg of amalgam comprising 80% by weight of Hg and 20% by weight of Na and xenon, which at 300 K. had a pressure of 13.3 kPa.

Each of the two electrodes was provided with a tungsten electrode beam having a diameter of 1.1 mm. One end of each electrode beam was passed through a respective cup-shaped lead-through member of niobium, the wall of the cup-shaped lead-through member being deformed away from the discharge space and laterally clampingly engaging around the electrode beam. The deformed part, measured in the longitudinal direction of the niobium cup-shaped lead-through, was about 100 μm. The lateral engagement along the beam extended over a length of 0.25 mm. Each cup-shaped lead-through member had an outer diameter of 3 mm and a wall thickness of about 0.25 mm. The electrode beam and the lead-through member were connected to each other in a gas-tight manner by means of a titanium soldering mass on the side remote from the discharge space.

In the manufacture of the lamp, each niobium lead-through member was provided with a hole having a diameter of 1 mm before the end of the electrode beam was passed through the wall of the lead-through member.

In the case of another practical lamp, having a power rating of 35 W, the inner diameter of the niobium cup-shaped lead-through members was 2 mm, while these members each had a wall thickness of 0.125 mm. In this lamp, during the manufacture, the cup-shaped lead-through members were not provided beforehand with a hole for passing the electrode beams. The electrode beams had a diameter of 0.3 mm. The lateral engagement extended in this case over a length of about 0.125 mm and the size of the deformed part, measured in the longitudinal direction of the cup-shaped lead-through member, was about 30 μm.

What is claimed is:

1. A high-pressure discharge lamp comprising a ceramic discharge vessel having a wall enclosing a discharge space containing an ionizable filling, and two electrodes within said vessel, between which a discharge path extends, a cup-shaped lead-through member having an end wall and a side wall, passing through the vessel wall, and sealed in a gas-tight manner to the vessel wall along an exterior surface of the member side wall, at least one of said electrodes comprising an electrode beam having an end which passes through said end wall, characterized in that said end wall clampingly engages around said electrode beam over a length along said beam of at most the diameter of the beam, and at the location of the clamping engagement, said end wall is deformed away from the discharge space.

2. A lamp as claimed in claim 1, characterized in that the open end of the lead-through member is directed away from the discharge space.

3. A high-pressure discharge lamp comprising a ceramic discharge vessel having a wall enclosing a discharge space containing an ionizable filling, and two electrodes within said vessel, between which a discharge path extends, a cup-shaped lead-through member having an end wall and a side wall, passing through the vessel wall, and sealed in a gas-tight manner to the vessel wall along an exterior surface of the member side wall, at least one of said electrodes comprising an electrode beam having an end which passes through said end wall, characterized in that said end wall clampingly engages around said electrode beam over a length along said beam of at most the diameter of the beam, at the location of the clamping engagement, said end wall is deformed away from the discharge space, and said beam has an end remote from said discharge space, and the lamp comprises a mass of sealing material surrounding and permanently connecting said electrode beam end to at least the deformed portion of said lead-through end wall.

4. A lamp as claimed in claim 3, characterized in that the open end of the lead-through member is directed away from the discharge space, and said mass of sealing material is entirely external to said discharge space, and fills the closed end portion defined by said cup-shaped member.

* * * * *